US007236733B2

(12) United States Patent
Tsueda et al.

(10) Patent No.: US 7,236,733 B2
(45) Date of Patent: Jun. 26, 2007

(54) APPARATUS FOR FIXING TONER ON TRANSFERRED MATERIAL

(75) Inventors: Yoshinori Tsueda, Fuji (JP); Satoshi Kinouchi, Tokyo (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/805,308

(22) Filed: Mar. 22, 2004

(65) Prior Publication Data

US 2005/0207805 A1 Sep. 22, 2005

(51) Int. Cl.
*G03G 15/20* (2006.01)

(52) U.S. Cl. ..... 399/333; 399/330

(58) Field of Classification Search ..... 339/330, 339/333, 336, 328; 219/469, 470, 471, 216, 219/619, 634, 670; 492/46
See application file for complete search history.

(56) References Cited

U.S. PATENT DOCUMENTS 3,751,216 A * 8/1973 Gregory ..... 432/62
4,180,717 A * 12/1979 Lenk et al. ..... 219/619
5,303,016 A * 4/1994 Oda et al. ..... 399/329
5,832,354 A * 11/1998 Kouno et al. ..... 399/330
6,021,303 A * 2/2000 Terada et al. ..... 399/328
6,026,273 A 2/2000 Kinouchi et al.
6,035,174 A * 3/2000 Ito et al. ..... 399/328
6,037,576 A * 3/2000 Okabayashi et al. ..... 219/619
6,055,403 A * 4/2000 Watanabe ..... 399/328
6,069,347 A * 5/2000 Genji et al. ..... 219/619
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.

(Continued)

FOREIGN PATENT DOCUMENTS

JP 04348008 A * 12/1992

(Continued)

OTHER PUBLICATIONS

U.S. Appl. No. 10/799,770, filed Mar. 15, 2004, Kikuchi et al.

(Continued)

*Primary Examiner*—Diego Gutierrez
*Assistant Examiner*—Travis Reis
(74) *Attorney, Agent, or Firm*—Foley & Lardner LLP

(57) ABSTRACT

The present invention relates to a heat generator including a central shaft, an elastic body formed to be a predetermined thickness at a circumference of the central shaft, a conductor layer formed to be a predetermined thickness at a circumference of the elastic body, and a second elastic body formed to be a predetermined thickness at a circumference of the conductor layer, and an apparatus including a magnetic field generator which provides a magnetic field such that the conductor layer of the heat generator can generate heat, and a pressure member which is provided along the central shaft of the heat generator, and applies pressure that deforms the elastic body layer by a predetermined amount to a predetermined position of the central shaft or the heating generator.

14 Claims, 5 Drawing Sheets

U.S. PATENT DOCUMENTS

| | | | | |
|---|---|---|---|---|
| 6,337,969 | B1 | 1/2002 | Takagi et al. | |
| 6,415,128 | B1 | 7/2002 | Takagi et al. | |
| 6,438,335 | B1 | 8/2002 | Kinouchi et al. | |
| 6,442,366 | B1 * | 8/2002 | Hartley et al. | 399/336 |
| 6,643,476 | B1 | 11/2003 | Kinouchi et al. | |
| 6,643,491 | B2 | 11/2003 | Kinouchi et al. | |
| 6,724,999 | B2 | 4/2004 | Kikuchi et al. | |
| 6,725,000 | B2 | 4/2004 | Takagi et al. | |
| 6,763,206 | B2 | 7/2004 | Kinouchi et al. | |
| 6,882,807 | B2 * | 4/2005 | Sakagami | 399/69 |
| 6,957,036 | B2 * | 10/2005 | Kikuchi et al. | 399/333 |
| 2002/0048472 | A1 * | 4/2002 | Samei | 399/328 |
| 2002/0098020 | A1 * | 7/2002 | Omoto et al. | 399/328 |
| 2002/0190060 | A1 * | 12/2002 | Imai et al. | 219/619 |
| 2003/0113143 | A1 * | 6/2003 | Maeda et al. | 399/328 |
| 2003/0147679 | A1 * | 8/2003 | Shimizu et al. | 399/328 |
| 2003/0219271 | A1 | 11/2003 | Kinouchi et al. | |
| 2004/0141038 | A1 | 7/2004 | Takagi et al. | |
| 2004/0169036 | A1 * | 9/2004 | Katakabe et al. | 219/619 |
| 2004/0173603 | A1 | 9/2004 | Kinouchi et al. | |
| 2004/0175211 | A1 | 9/2004 | Sone et al. | |
| 2004/0175212 | A1 | 9/2004 | Tsueda et al. | |
| 2004/0179874 | A1 | 9/2004 | Kinouchi et al. | |
| 2004/0184852 | A1 | 9/2004 | Takagi et al. | |
| 2004/0188421 | A1 | 9/2004 | Takagi et al. | |
| 2004/0188422 | A1 | 9/2004 | Wasai et al. | |
| 2004/0238531 | A1 | 12/2004 | Kikuchi et al. | |
| 2004/0265021 | A1 | 12/2004 | Kinouchi et al. | |

FOREIGN PATENT DOCUMENTS

| | | | |
|---|---|---|---|
| JP | 2002-213434 | A | 7/2002 |
| JP | 2002-295452 | A | 10/2002 |

OTHER PUBLICATIONS

U.S. Appl. No. 10/820,138, filed Apr. 8, 2004, Sone et al.
U.S. Appl. No. 10/805,514, filed Mar. 22, 2004, Kinouchi et al.
U.S. Appl. No. 10/805,305, filed Mar. 22, 2004, Sone et al.
U.S. Appl. No. 10/805,507, filed Mar. 22, 2004, Kikuchi et al.
U.S. Appl. No. 10/805,420, filed Mar. 22, 2004, Sone et al.
U.S. Appl. No. 10/805,522, filed Mar. 22, 2004, Kikuchi et al.

* cited by examiner

APPARATUS FOR FIXING TONER ON TRANSFERRED MATERIAL

BACKGROUND OF THE INVENTION

1. Field of the Invention

The present invention relates to a heating apparatus using induction heating, and in particular, to a fixing apparatus available for a copying apparatus, a printer apparatus or the like which is an electrophotographic system using a thermal melting image developing agent, the fixing apparatus fixing the image developing agent on a recording object.

2. Description of the Related Art

A fixing apparatus built into a copying apparatus using an electrophotographic process heats and melts toner (image developing agent) formed on a fixing material (recording material), and fixes the toner to the recording material. In recent years, induction heating has been widely used as a heating method in which a heating time, which is a time from the point in time when electric power supply is started until the time when it reaches a fixable temperature, can be reduced. Further, there is a report in which the characteristic of a roller (or belt) as one of the factors by which a heating time can be reduced.

For example, in Jpn. Pat. Appln. KOKAI Publication No. 2002-295452, a roller having elasticity and adiathermancy, and a heating apparatus using the roller are shown. As the feature of the heating apparatus disclosed in this document, there is shown that the starting of heating is fast (a time from the point in time when electric power supply is started until the time when a fixable temperature is reached).

For example, in Jpn. Pat. Appln. KOKAI Publication No. 2002-213434, a heating apparatus is shown in which toner fixed on a recording paper is hardly stripped off. As the feature of the heating apparatus disclosed in this document, there is shown that a contact length between a heating roller and a pressure roller in the direction in which the recording paper is conveyed, i.e., a nip width, is made sufficiently large.

However, even when the heating apparatuses shown in the two documents described above are used, heat generated at the conductor layer portion is not necessarily sufficient for fixing toner to a recording material due to a material of a core material of a roller, i.e., a rotator, or a distance between the core material and a conductor layer (fixing surface) of the surface. Further, there is verified that a rise in the temperature of the core material which does not contribute to a rise in the temperature of the fixing surface.

BRIEF SUMMARY OF THE INVENTION

An object of the present invention is to provide a fixing apparatus in which a time from starting of heating, i.e., the point in time when electric power supply is started, until the time when it reaches a fixable temperature is short, and toner can be firmly fixated to a recording material.

According to one aspect of the present invention, there is provided a heat generator for use in a heating apparatus, comprising:

a central shaft;

an elastic body formed to be a predetermined thickness at a circumference of the central shaft;

a conductor layer formed to be a predetermined thickness at a circumference of the elastic body; and a second elastic body formed to be a predetermined thickness at a circumference of the conductor layer, wherein the heat generator is elastically deformed at a position which contacts a member to be contacted with the second elastic body at a predetermined pressure, and can supply heat and pressure to a medium to be supplied between the second elastic body and the member to be contacted, and an image developing agent carried by the medium.

According to another aspect of the present invention, there is provided a fixing apparatus comprising:

a heat generator including a central shaft, an elastic body formed to be a predetermined thickness at a circumference of the central shaft, a conductor layer formed to be a predetermined thickness at a circumference of the elastic body, and a second elastic body formed to be a predetermined thickness at a circumference of the conductor layer;

a magnetic field generator which provides a magnetic field such that the conductor layer of the heat generator can generate heat; and a pressure member which is provided along the central shaft of the heat generator, and applies pressure that deforms the elastic body layer by a predetermined amount to a predetermined position of the central shaft or the heating generator, wherein the central shaft includes material of a quality which does not generate heat when a magnetic field is supplied thereto, or which is not affected by magnitude of a magnetic field used as heat which the conductor layer should generate.

According to another aspect of the present invention, there is provided an apparatus for fixing an image developing agent carried by a recording material onto the recording material, comprising:

a heat generator which includes a region formed from a first material in which a resistivity is $10^6$ (Ω·m) or more, a Curie temperature is 180° C. or more, and a relative permeability is 200 or more, and a region formed from a second material different in a characteristic from the first material, the heat generator further including a central shaft, an elastic body formed to be a predetermined thickness at a circumference of the central shaft, a conductor layer formed to be a predetermined thickness at a circumference of the elastic body, and a second elastic body formed to be a predetermined thickness at a circumference of the conductor layer;

a magnetic field generator which provides a magnetic field such that the conductor layer of the heat generator can generate heat; and a pressure member which is provided along the central shaft of the heat generator, and applies pressure that deforms the elastic body layer by a predetermined amount to a predetermined position of the central shaft or the heating generator.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of the present invention will be described with reference to the drawings.

Figure 1:
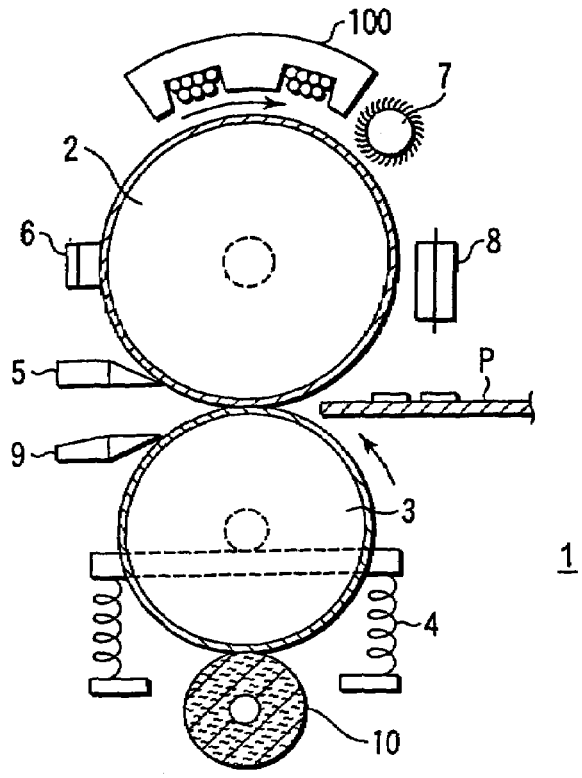
FIG. 1 is a schematic diagram illustrating an entire configuration of a fixing apparatus to which an embodiment of the present invention is applied.

FIG. 1 is a schematic diagram illustrating an entire configuration of a fixing apparatus to which the embodiment of the present invention is applied.

As shown in FIG. 1, a fixing apparatus 1 has a heating roller 2, a pressure roller 3, and a heating apparatus 100.

The heating roller 2 is a rotator provided with an internal structure which will be described hereinafter by FIG. 2. Note that the internal structure may be applied to the pressure roller 3.

The pressure roller 3 is an elastic body in which silicon rubber, fluoro rubber, or the like is coated on, for example, the circumference of a metal core material. The pressure roller 3 has the core material, and the roller 3 is pressed by a predetermined pressure with respect to the heating roller 2 by a pressurizing mechanism 4 in a state in which the axis of the core material is arranged to be substantially parallel to the axis (core material) of the heating roller 2, whereby a nip (fixing region) is provided at a position where the pressure roller 3 contacts with the outer circumferential surface of the heating roller 2.

The heating roller 2 is made to rotate in the direction of the arrow by supplying driving force of a driving motor (not shown) by a power transmission mechanism (not shown). Accordingly, the pressure roller 3 rotates in the arrow direction due to the coupled driving.

At the outer circumferential surface of the heating roller 2, on the basis of the nip portion, a stripping pawl 5, thermistors 6 (a plurality of thermistors 6 in the longitudinal direction of the heating roller 2), a cleaning member 7, a thermostat 8, and the like are sequentially arranged along the direction in which the roller 2 is made to rotate. The stripping pawl 5 strips a paper (recording material) P guided by the nip portion from the heating roller 2. The thermistor 6 detects a temperature of the heating roller 2. The cleaning member 7 eliminates toner fixed to the surface (outer circumferential surface) of the heating roller 2, powder generated from the paper P, and the like. The thermostat 8 detects an abnormality in a surface temperature of the heating roller 2, and shuts off supplying of electric power to the heating apparatus 100. The thermistor 6 and the thermostat 8 are provided at the positions where are not affected by the heating apparatus 100, i.e., line of magnetic force generated from a magnetic flux generator such as a coil, for generating magnetic flux.

At the outer circumferential surface of the pressure roller 3, on the basis of the nip portion, a stripping pawl 9 and a cleaning roller 10 are provided along the direction in which the roller 3 is made to rotate. The stripping pawl 9 strips the paper P from the roller 3. The cleaning roller 10 eliminates toner fixed to the surface of the roller 3, powder generated from the paper (recording material), and the like.

The plurality of thermistors 6 are disposed in the longitudinal direction of the heating roller 2, so that the thermistors 6 can measure a temperature at an arbitrary position in the longitudinal direction (the axial direction) of the heating roller 2. Accordingly, by controlling the heating apparatus 100 by using a temperature controller (not shown), a deviation in the temperature in the axial direction of the heating roller 2 is set to a minimum.

Figure 2:
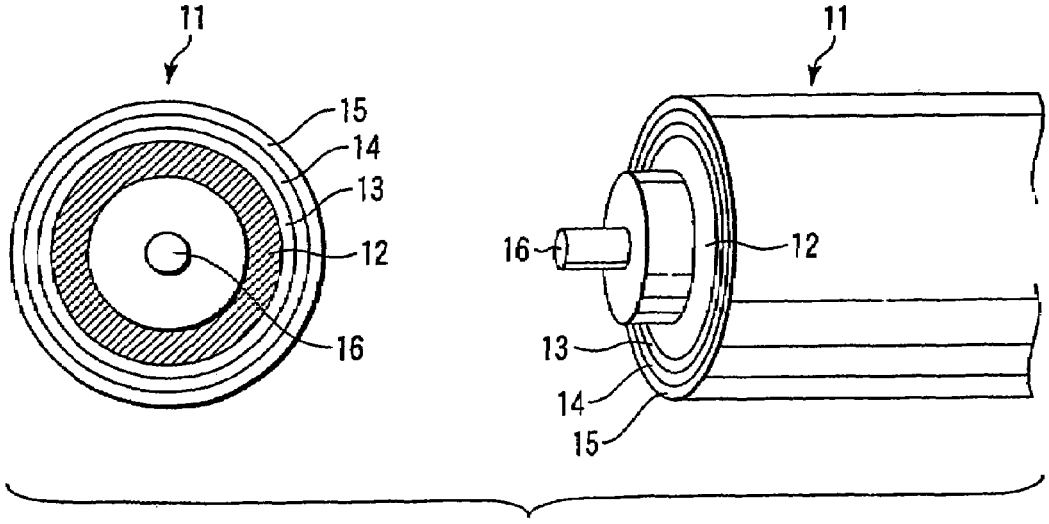
FIG. 2 is a schematic diagram illustrating an internal structure of a rotator which is available for at least one of a heating roller and a pressure roller of the fixing apparatus shown in FIG. 1.

FIG. 2 illustrates an internal structure of a rotator which can be used for at least one of the heating roller 2 and the pressure roller 3 of the fixing apparatus 1 shown in FIG. 1.

The rotator 11 is a cylinder shape at which a conductor layer 13, an elastic body layer 14, and a mold release layer 15 are sequentially arranged on the surface of an elastic body layer 12. A core material 16 is provided at the center of the rotator 11. One or both of the elastic body layer 14 and the mold release layer 15 may be omitted on the basis of the fixing characteristic that is determined in accordance with an image forming apparatus (not shown) in which the fixing apparatus is built-in.

The elastic body layer 12 is formed from, for example, silicon rubber, or heat resistant sponging rubber foam, etc.

The conductor layer 13 is formed from a material at which eddy-current is generated due to electric power being supplied thereto by the heating apparatus 100, for example, nickel or the like, and rises in temperature (generates heat) with respect to the magnitude of the eddy-current.

The elastic body layer 14 is formed from, for example, silicon rubber or the like, and applies a predetermined pressure to the paper P conveyed to the nip portion contacting with the pressure roller 3, and an image developing agent electrostatically carried on the paper, i.e., toner.

By configuring the rotator 11 from the elastic body layer 12, the conductor layer 13, and the elastic body layer 14 which are shown in FIG. 2, heat can be generated in the vicinity of the surface of the rotator 11 when the conductor layer is heated by induction heating. Accordingly, energy (electric power) utilization efficiency can be improved, and it is possible to reduce a heating time (waiting time) required for the temperature of the heating roller 2 to rise to a fixable temperature at which toner can be fixed on a paper after electric power is supplied to the heating apparatus 100. Further, by adjusting the layer thickness and the hardness of the materials of the elastic body layer 12, the conductor layer 13, and the elastic body layer 14, the hardness of the outer circumferential surface of the rotator 11 can be adjusted. In accordance therewith, the nip width and the stripping performance (characteristic) can be arbitrarily set.

Figure 3:
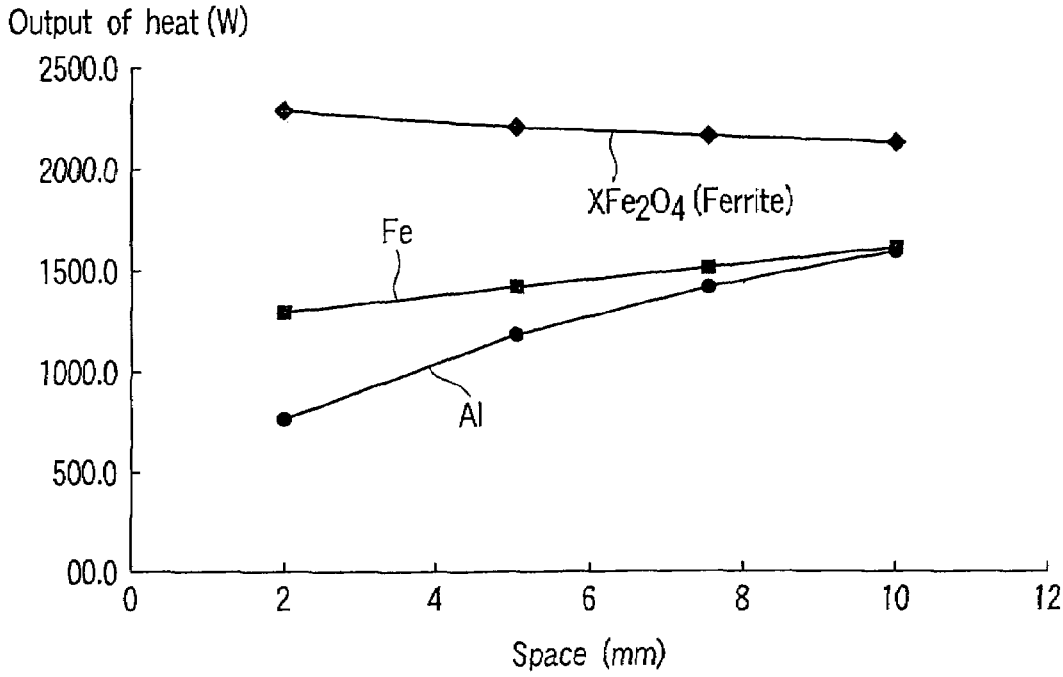
FIG. 3 is a graph showing results in which, when a material of a conductor layer used for the rotator (the heating roller or the pressure roller) is Ni (nickel) and a material of a core material is changed, variations in quantity of heat generated from the conductor layer are determined with respect to distances between the conductor layer and the core material.
Figure 4:
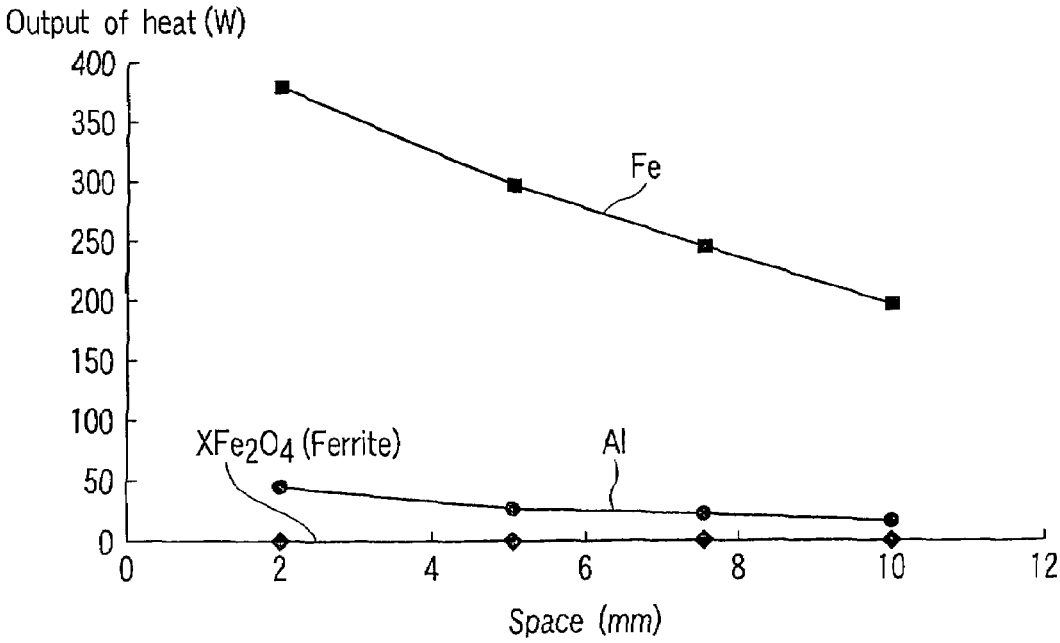
FIG. 4 is a graph showing variations in magnitude of heat generated from the core material when the material of the conductor layer used for the rotator (the heating roller or the pressure roller) is Ni, and a distance between the core material and the conductor layer is changed.

Hereinafter, the results of the experiment for optimizing the respective thicknesses of the elastic body layer 12, the conductor layer 13, and the elastic body layer 14, i.e., a distance between the conductor layer and the core material will be shown (FIGS. 3 and 4).

FIG. 3 shows the results in which, when the material of the conductor layer 13 is Ni (nickel), and the material of the core material 16 is changed, variations in quantity output of heat generated from the conductor layer 13 are determined with respect to the distance between the conductor layer and the core material. FIG. 4 shows the magnitudes output of heat generated from the core material when the material of the conductor layer 13 is Ni, and the distance between the core material 16 and the conductor layer 13 is changed.

It can be distinguished from FIG. 3 that there exist materials of the core materials in which heat generated from an Ni layer is reduced when the distance between the conductor layer and the core material is close, i.e., the thickness of the elastic body layer is thin. Namely, it can be understood that Fe (iron) and $Xfe_2O_4$ (ferrite, i.e., iron oxide or a compound including iron oxide) is preferable as the material of the core material 16.

The thickness of the elastic body layer 12 of the rotator 11 is subjected to an image forming speed (process speed) of the image forming apparatus body (not shown). However, in many cases, the thickness of the elastic body layer 12 is, for example, about 3 mm.

Therefore, in order to make the quantity of heat generated at the Ni layer being a quantity output of heat available for the fixing apparatus 1, as the material of the elastic body, given that a resistivity is $\rho(\Omega\cdot m)$ and a relative permeability is $\mu$, it is preferable that $$\mu \leqq 2.81\times10^{9}\rho$$

is satisfied.

Note that, when ferrite is used as the core material, it is preferable that the resistivity is $10^6$ $(\Omega\cdot m)$ or more, the Curie temperature is 180° C. or more, and the relative permeability is 200 or more. In this case, heat by the core material 16 is hardly generated. On the other hand, it has been known that ferrite is a high price as compared with iron (Fe), copper (Cu), and the like, and is not resistant (brittle) to an impact.

As a material of the core material 16, for example, non-ferrous metal such as Cu (copper), a high-heat resistant resin material, ceramic, or the like can be used.

Figure 5:
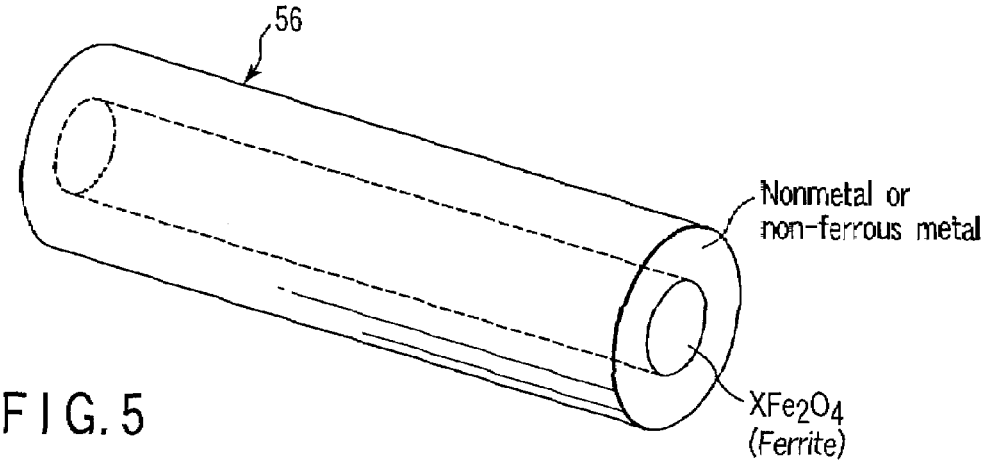
FIG. 5 is a schematic diagram illustrating one example of another embodiment of the rotator shown in FIG. 2.

Further, as shown in FIG. 5, as a core material 56, by coating the circumference of ferrite with a tube shaped resin material or the like, a ferrite content can be reduced, and the resistance to an impact can be improved.

Figure 6:
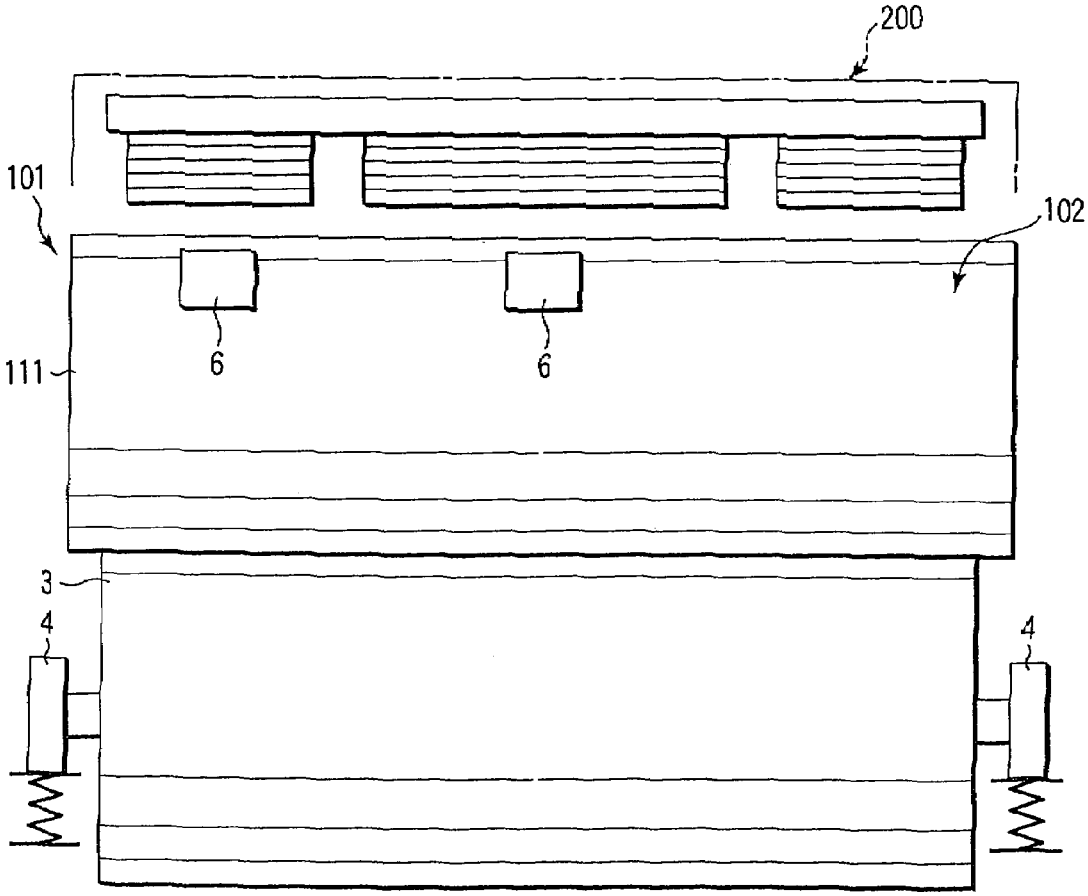
FIG. 6 is a schematic diagram illustrating one example of another configuration of the fixing apparatus to which the embodiment of the present invention is applied.

FIG. 6 is a schematic diagram illustrating one example of another configuration of the fixing apparatus to which the embodiment of the present invention is applied. Note that the configurations which are similar to or the same as those described above by FIG. 1 are denoted by the same reference numerals, and detailed descriptions thereof will be omitted.

As shown in FIG. 6, the fixing apparatus 101 has a heating roller 102 (rotator 111), a pressure roller 3, and a heating apparatus 200. Note that the fixing apparatus 101 is substantially the same as the fixing apparatus 1 shown in FIG. 1 except for the points of the heating apparatus 200, the rotator 111 (heating roller 102), and the number of the thermistors 6.

At the fixing apparatus 101 shown in FIG. 6, the heating apparatus 200 is divided into, for example, three in the longitudinal direction of the rotator 111 (hereinafter, this is the heating roller 102 in the present embodiment). The heating apparatus 200 may be configured such that only a magnetic field generator (coil body) provided at the interior thereof is divided into three parts.

The respective heating apparatuses or the internal coil bodies are divided at predetermined positions relating to (associated with) a width of the paper P conveyed between the heating roller 102 and the pressure roller 3, i.e., a length in the direction perpendicular to the direction in which the paper is conveyed.

Since the plurality of thermistors 6 are disposed in the longitudinal direction of the heating roller 102, the thermistors 6 can measure independently a temperature at an arbitrary position in the longitudinal direction (the axial direction) of the heating roller 102. Accordingly, by controlling electric power to be supplied to individual coil bodies of the heating apparatus 200 by using a temperature controller (not shown), a deviation in the temperature in the axial direction of the heating roller 102 is set to a minimum.

Figure 7:
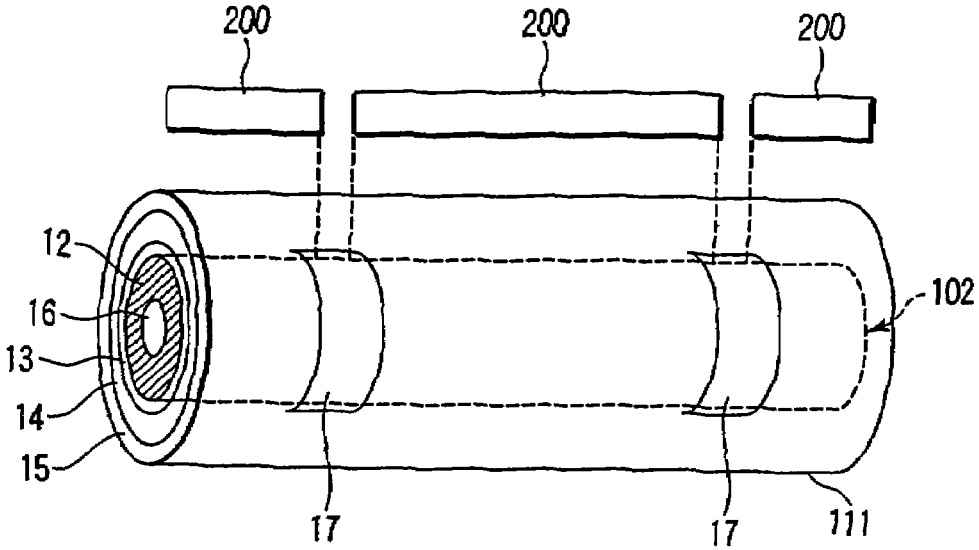
FIG. 7 is a schematic diagram illustrating an internal structure of a heating roller to be built into the fixing apparatus shown in FIG. 6.

FIG. 7 illustrates an internal structure of the heating roller 102 to be built into the fixing apparatus shown in FIG. 6.

The heating roller 102 shown in FIG. 7 is a cylinder shape at which the conductor layer 13, the elastic body layer 14, and the mold release layer 15 are sequentially arranged on the surface of the elastic body layer 12.

In the longitudinal direction of the elastic body layer 12, at the positions corresponding to the positions where the heating apparatuses 200 or the coil bodies in the heating apparatus 200 have been divided, there are provided heat transfer members 17 for diffusing (transmitting) the heat generated by the conductor layer 13 in the longitudinal direction of the heating roller by heat conduction.

Namely, the heat transfer members 17 is provided, in the longitudinal direction of the heating roller 102, at regions where the intensity of an induction field from the heating apparatus 200 is easily reduced, whereby a heat distribution in the longitudinal direction of the heating roller 102 can be made to be uniform.

As the heat transfer member 17, for example, copper (Cu) or the like can be used. The heat transfer members 17 may be directly provided at predetermined positions at the outer circumference of the elastic body layer 12. Alternatively, the conductor layer 13 is made to be a tube shape, Cu is provided at the predetermined positions at the interior by plating or the like, and thereafter, the elastic body layer 12 may be formed at the inside. Because the distance between the conductor layer 13 and the core material 16 is made to be uniform by fractioned of percentages by proving the heat transfer members 17, the thickness of the elastic body layer 12 at the portions at which the heat transfer members 17 are provided may be made thinner by an amount corresponding to the thickness of the heat transfer members 17. In this case, heat generated by the conductor layer 13 can be prevented from being varied due to the distance between the core material 16 and the conductor layer 13.

Figure 8:
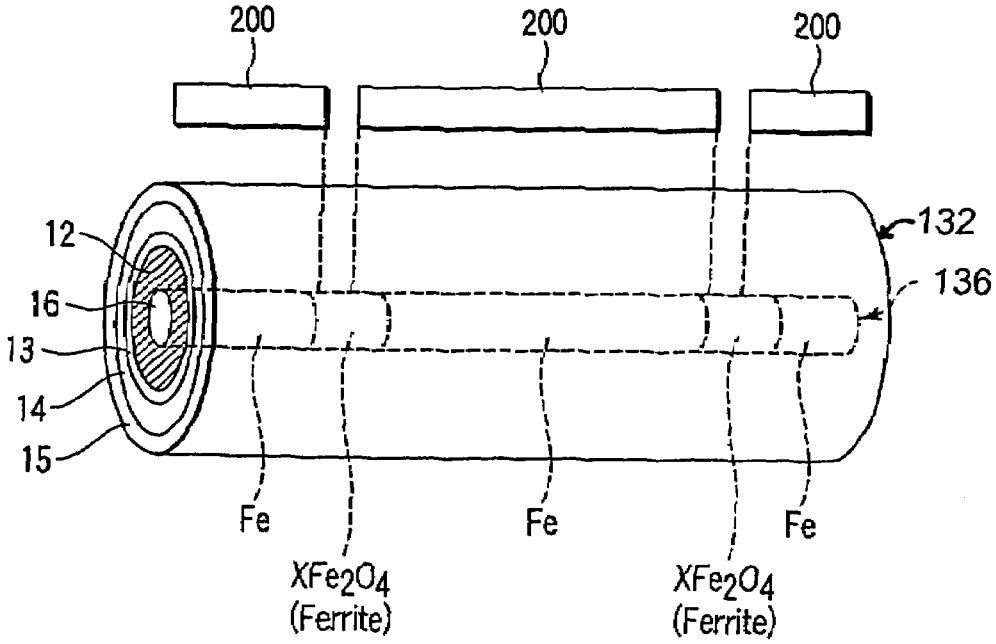
FIG. 8 is a schematic diagram illustrating one example of another embodiment of the internal structure of the heating roller to be built into the fixing apparatus shown in FIG. 6.

FIG. 8 illustrates one example of another embodiment of the internal structure of the heating roller 102 to be built into the fixing apparatus shown in FIG. 6.

A heating roller 132 shown in FIG. 8 is a cylinder shape at which the conductor layer 13, the elastic body layer 14, and the mold release layer 15 are sequentially arranged on the surface of the elastic body layer 12. At the center of the heating roller 132, a core material 136 is provided in which the portions corresponding to the regions at which the coil body of the heating apparatus 200 or the heating apparatus 200 itself is divided are formed from, for example, iron oxide or alloy including iron oxide (ferrite).

The heating roller 132 shown in FIG. 8, as the core material 136, can reduce the generation of heat in the longitudinal direction being made to be uniform due to reduction of the magnetic flux densities at the regions into which the heating apparatus 200 or the coil body of the heating apparatus 200 is divided. Further, as compared with the entire core material 56 made of ferrite described above by FIG. 5, the cost can be reduced. In this case, by coating the core material 136, in particular, at least the ferrite portions thereof with a tube shaped resin material or the like, the ferrite content can be further reduced, and the resistance to impact can be improved.

Figure 9:
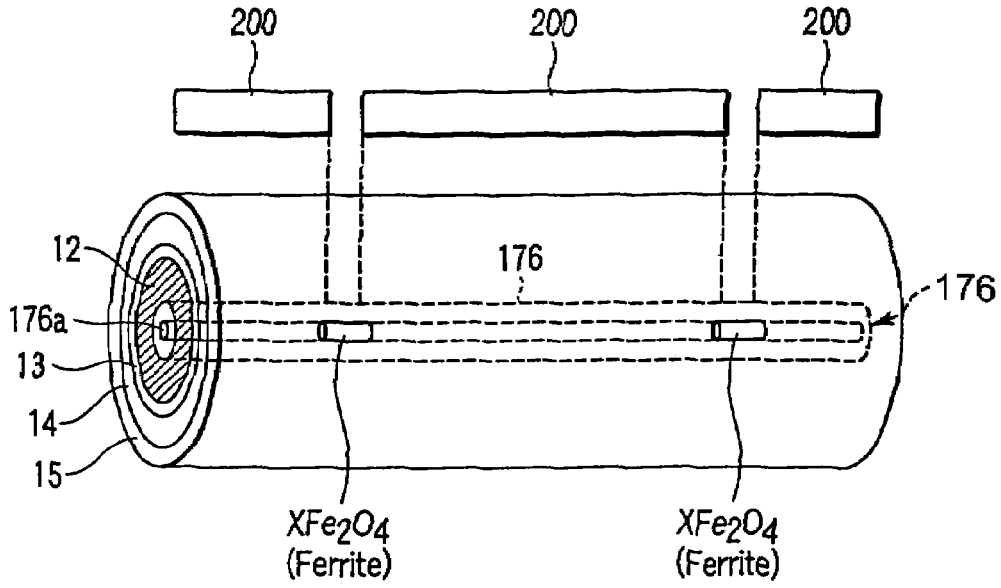
FIG. 9 is a schematic diagram illustrating one example of another embodiment of the core material available for the heating roller shown in FIG. 8.

As shown in FIG. 9, by passing a shaft 176*a* through in the vicinity of the center of a core material 176, in the same way, the resistance to an impact can be improved, and the ferrite content can be reduced. The magnetic permeability of the shaft 176*a* is low, and a material whose shearing resistance is high is preferable. The shape (cross-section) of the shaft 176*a* may be a circle or a polygon.

Figure 10:
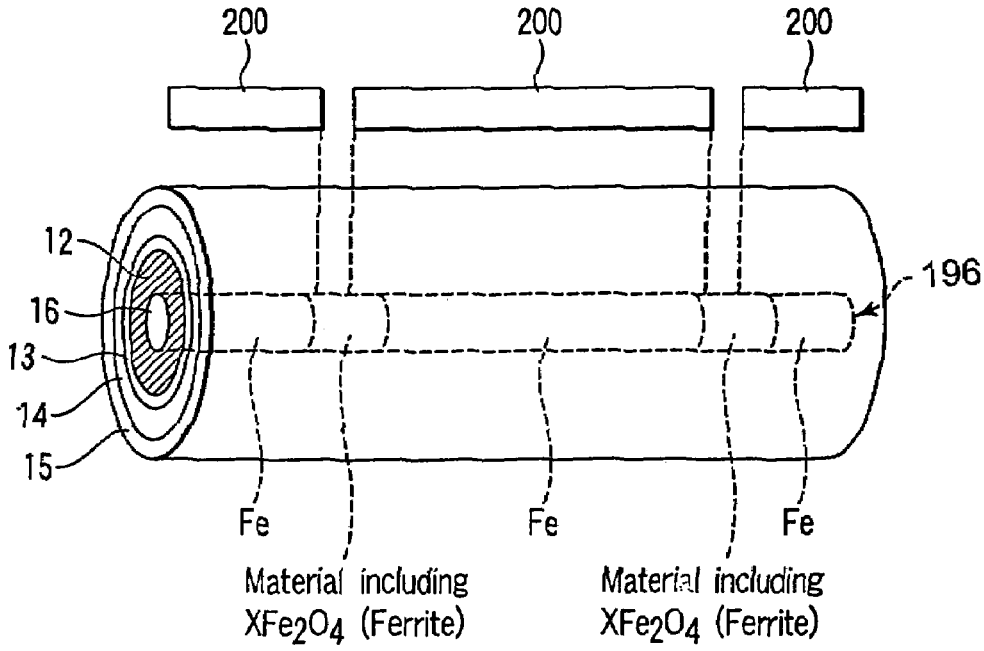
FIG. 10 is a schematic diagram illustrating one example of even other embodiment of the core material available for the heating roller shown in FIG. 8.

As shown in FIG. 10, by forming the ferrite portions of a core material 196 from resin materials including ferrite, the resistance to impact can be improved, and the quantity consumed can be reduced.

As described above, the heating apparatus of the present invention can efficiently convert a magnetic field to be supplied to the conductor layer into heat. The heating apparatus of the invention can reduce a loss of energy (magnetic field) which is, as generation of heat at the conductor layer, not used.

By applying the heating apparatus of the invention to the fixing apparatus, a time required for raising a temperature of a heating object to a fixable temperature can be reduced while reducing electric power consumption (magnetic field established amount). Further, the fixing of the image formed on the recording material can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heat generating apparatus for use in a heating apparatus, comprising:

coil members arranged along an axis extending in a longitudinal direction of a heat generating member, and located outward of the heat generating member;

a central shaft in which core materials are made from ferrite and an outer circumference is coated with resin or non-ferrous metal, the central shaft being provided to extend along the axis, the core materials being arranged in positions corresponding to gaps between the coil members;

an elastic body formed to be a predetermined thickness at a circumference of the central shaft;

a conductor layer formed to be a predetermined thickness at a circumference of the elastic body; and a second elastic body formed to be a predetermined thickness at a circumference of the conductor layer wherein the ferrite material of the central shaft is divided into a plurality of portions in a longitudinal direction, a first subset of said plurality of divided portions being ferrous (Fe), a second subset of said plurality of divided portions being ferrite.

2. A fixing apparatus according to claim 1, wherein the central shaft is located inward of the heat generating member.

3. A fixing apparatus comprising:

a heat generator including (i) coil members arranged along an axis extending in a longitudinal direction of a heat generating member, and located outward of the heat generating member, (ii) a central shaft in which core materials are made from ferrite and an outer circumference is coated with resin or non-ferrous metal, the central shaft being provided to extend along the axis, the core materials being arranged in positions corresponding to gaps between the coil members, (iii) an elastic body formed to be a predetermined thickness at a circumference of the central shaft, (iv) a conductor layer formed to be a predetermined thickness at a circumference of the elastic body, and (v) a second elastic body formed to be a predetermined thickness at a circumference of the conductor layer;

a magnetic field generator which provides a magnetic field such that the conductor layer of the heat generator can generate heat; and a pressure member which is provided along the central shaft of the heat generator, and applied pressure that deforms the elastic body layer by a predetermined amount to a predetermined position of the central shaft or the heating generator wherein the ferrite material of the central shaft is divided into a plurality of portions in a longitudinal direction, a first subset of said plurality of divided portions being ferrous (Fe), a second subset of said plurality of divided portions being ferrite.

4. A fixing apparatus according to claim 3, wherein the coil members are located outward of the second elastic body.

5. A fixing apparatus according to claim 3, wherein the central shaft is located inward of the heat generating member.

6. A heat generating apparatus for use in a heating apparatus, comprising:

coil members arranged along an axis extending in a longitudinal direction of a heat generating member, and located outward of the heat generating member;

a central shaft in which a core material is made from ferrite, the central shaft being covered by material having a shearing resistance, the central shaft being provided to extend along the axis;

an elastic body formed to be a predetermined thickness at a circumference of the central shaft;

a conductor layer formed to be a predetermined thickness at a circumference of the elastic body; and a second elastic body formed to be predetermined thickness at a circumference of the conductor layer wherein the ferrite material of the central shaft is divided into a plurality of portions in a longitudinal direction, a first subset of said plurality of divided portions being ferrous (Fe), a second subset of said plurality of divided portions being ferrite.

7. A fixing apparatus according to claim 6, wherein the central shaft is located inward of the heat generating member.

8. A heat generating apparatus for use in a heating apparatus, comprising:

first means, which is cylindrically formed along an axis extending in a longitudinal direction of a heat generating member, and located outward of the heat generating member, for creating heat;

second means for causing the first means to generate an eddy current;

third means, which is cylindrically formed along the axis and at an outer circumference of the first means, for covering the first means, the third means having elasticity;

fourth means, which is cylindrically formed along the axis and at an inner circumference of the first means, for holding the first means, the fourth means having elasticity;

fifth means, which is cylindrically formed along the axis and at an inner circumference of the fourth means, for supporting the fourth means, the fifth means including core materials made from ferrite; and sixth means for transferring heat of portions of the fourth means, which correspond to gaps between the second means wherein the ferrite material of the fifth means is divided into a plurality of portions in a longitudinal direction, a first subset of said plurality of divided portions being ferrous (Fe), a second subset of said plurality of divided portions being ferrite.

9. A heat generator according to claim 8, wherein the sixth means for transferring includes a conductor.

10. A fixing apparatus comprising:

a heat generating apparatus including (i) first means, which is cylindrically formed along an axis extending in a longitudinal direction of a heat generating member, and located outward of the heat generating member, for creating heat, (ii) second means for causing the first means to generate an eddy current, (iii) third means, which is cylindrically formed along the axis and at an outer circumference of the first means, for covering the first means, the third means having elasticity, (iv) fourth means, which is cylindrically formed along the axis and at an inner circumference of the first means, for holding the first means, the fourth means having elasticity, (v) fifth means, which is cylindrically formed along the axis and at an inner circumference of the fourth means, for supporting the fourth means, the fifth means including core materials made from ferrite, and (vi) sixth means for transferring heat of portions of the fourth means, which correspond to gaps between the second means wherein the ferrite material of the fifth means is divided into a plurality of portions in a longitudinal direction, each divided portion being ferrous.

11. A fixing apparatus according to claim 10, wherein the sixth means for transferring includes a conductor.

12. A fixing apparatus comprising:

a hollow shaft formed of one of metal and resin, and including a ferrite core located in the hollow shaft;

a metal layer provided outward of the shaft;

a coil provided outward of the metal layer, and causes the metal layer to generate an eddy current; and a pressure roller provided outward of the metal layer wherein the ferrite core is divided into a plurality of coil portions in a longitudinal direction, a first subset of said plurality of divided portions being ferrous (Fe), a second subset of said plurality of divided portions being ferrite.

13. The fixing apparatus according to claim 12, further comprising an elastic layer provided between the metal layer and the shaft.

14. The fixing apparatus according to claim 13, wherein and the ferrite core is provided in a position corresponding to a gap between the coil portions.

* * * * *